US006416360B1

(12) United States Patent
Zhang et al.

(10) Patent No.: US 6,416,360 B1
(45) Date of Patent: Jul. 9, 2002

(54) INPUT/OUTPUT CONNECTOR HAVING FIRMLY ASSEMBLED INSULATIVE HOUSING AND SHELL

(75) Inventors: Jian Qiang Zhang; Ren Li Bai, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/947,245

(22) Filed: Sep. 5, 2001

(30) Foreign Application Priority Data

Jun. 13, 2001 (TW) ..... 90209864 U

(51) Int. Cl.[7] ..... H01R 13/648
(52) U.S. Cl. ..... 439/607
(58) Field of Search ..... 439/607–610, 439/79

(56) References Cited

U.S. PATENT DOCUMENTS 6,179,661 B1 * 1/2001 Chiou ..... 439/607
6,193,552 B1 * 2/2001 Chiou et al. ..... 439/607
6,241,556 B1 * 6/2001 Chih ..... 430/607
6,247,967 B1 * 6/2001 Wu et al. ..... 439/607
6,267,623 B1 * 7/2001 Hisamatsu ..... 439/607
6,270,379 B1 * 8/2001 Huang et al. ..... 439/607

* cited by examiner

*Primary Examiner*—Gary F. Paumen
(74) *Attorney, Agent, or Firm*—Wei Te Chung

(57) ABSTRACT

An input/output port connector has an insulative housing (1), a plurality of conductive contacts (2) retained in the insulative housing (1) for surface mounting to a printed circuit board and a shell (3). The insulative housing (1) includes a pair of side arms (11) parallel to each other and an elongate body (12) defining a pair of slots (121) therein. The shell (3) includes a bottom plate (30), a top plate (31), a pair of side plates (32) projecting from the top plate (31) and a pair of connecting plates (33) joining the bottom plate (30) and the top plate (31). The bottom plate (30) defines a pair of angled engaging plates (301) for horizontally engaging with the slots (121) of the insulative housing (1) and preventing the shell (3) from displacing relative to the insulative housing (1).

1 Claim, 4 Drawing Sheets

INPUT/OUTPUT CONNECTOR HAVING FIRMLY ASSEMBLED INSULATIVE HOUSING AND SHELL

FIELD OF THE INVENTION

The present invention relates to a mobile phone connector, and particularly to an input/output (I/O) connector for a mobile phone.

BACKGROUND OF THE INVENTION

An input/output (I/O) connector is commonly used in a mobile phone connection system for transferring signals. A conventional connector as disclosed in JP Patent No. 10-241793 utilizes interference fitting in assembling the shell to the insulative housing. However, this structure will produce stress and deformation between the insulative housing and the shell during soldering the connector to a print circuit board (PCB), thus during subsequent cooling process, the insulative housing will displace relative to the shell because of the differences in thermal expansion coefficients, heat conductivity and stress therebetween, which will destroy the electrical connection between the conductive contacts and the trace on the PCB.

Another conventional connector as disclosed in JP Patent No. 11-185862 has a U-shaped stopping plate in a side plate of a shell for engaging with the insulative housing, however the engagement between the U-shaped stopping plate and the insulative housing can prevent the shell from displacing relative to the insulative housing only in horizontal direction, but not in vertical direction.

Hence, an improved I/O connector is needed to overcome the above-mentioned deficiencies of current I/O connectors.

SUMMARY OF THE INVENTION

Accordingly, the primary object of the present invention is to provide an Input/Output (I/O) connector for firmly assembling the insulative housing with the shell.

To achieve the above objects, an I/O port connector in accordance with the present invention comprises an insulative housing, a plurality of conductive contacts retained in the insulative housing for surface mounting to a PCB and a shell. The insulative housing includes a pair of side arms paralleled to each other and an elongate body defining a pair of slots therein. Each side arm has a first block and a second block at a bottom face thereof. The shell includes a bottom plate, a top plate, a pair of side plates projecting from the top plate and a pair of connecting plates joining the bottom plate and the top plate. The bottom plate has a first notch and a second notch for engaging with said first and second blocks, respectively. Furthermore the bottom plate comprises a pair of angled engaging plates for horizontally engaging with the slots of the insulative housing, and the engagement between the engaging plates and the slots will prevent the shell from displacing relative to the insulative housing.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
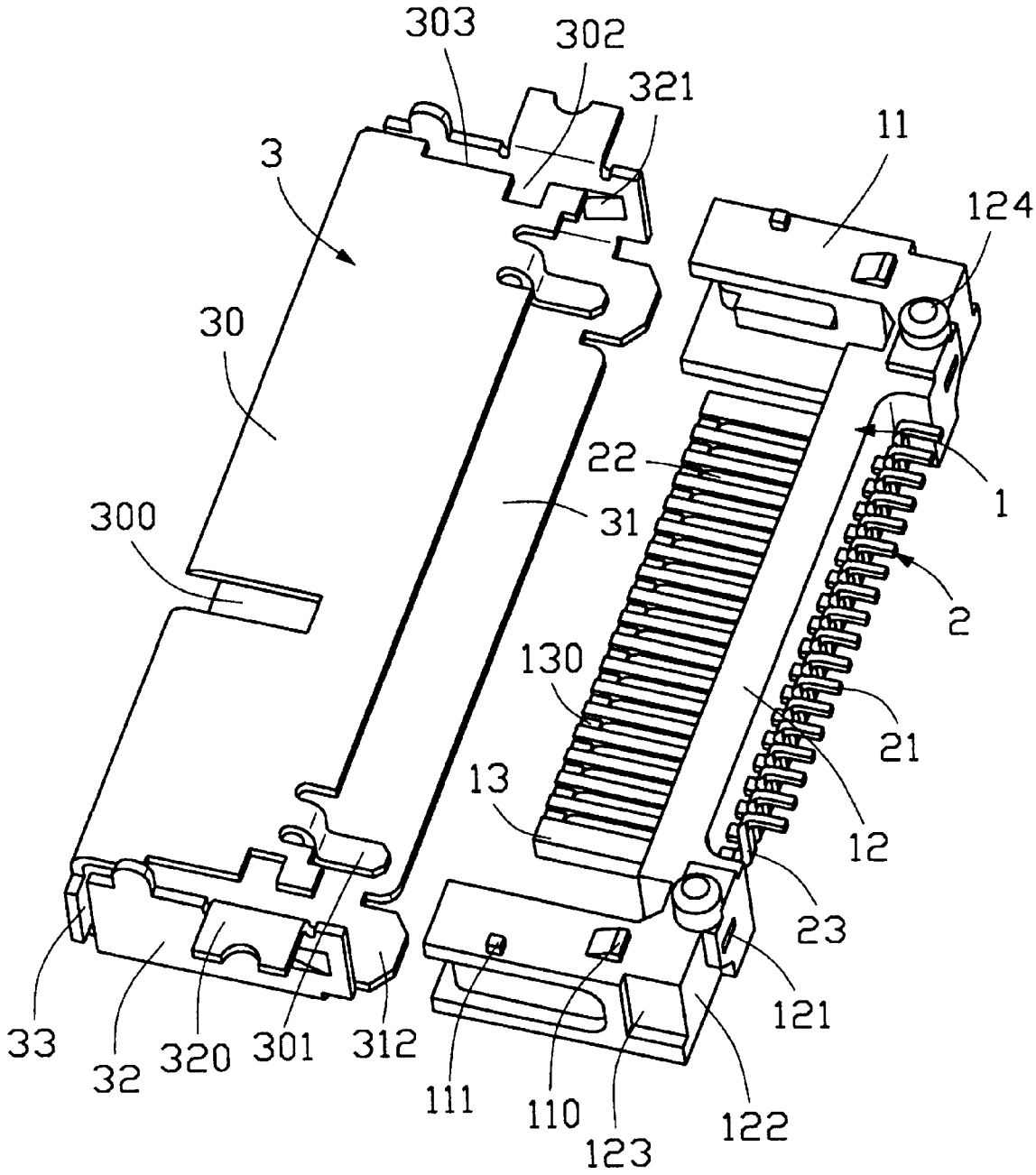
FIG. 1 is a perspective view of an I/O connector in accordance with the present invention, wherein the connector is viewed from the bottom side for clarity.

Referring to FIG. 1, an I/O connector in accordance with the present invention comprises an insulative housing 1, a plurality of conductive contacts 2 retained in the insulative housing 1 for surface mounting to a PCB (not shown) and a shell 3.

The insulative housing 1 includes a pair of side arms 11 paralleled to each other, an elongate body 12 connecting the side arms 11 and a tongue member 13. The tongue member 13 is parallel to the pair of side arms 11 and extends from the front of the elongate body 12. A plurality of elongate grooves 130 for receiving the conductive contacts 2 is formed in the tongue member 13. Each side arm 11 has a first block 110 and a second block 111 at a bottom face thereof. The elongate body 12 defines a pair of through slots 121 and a pair of first recesses 122 formed beside the slots 121. Each side face of the elongate body 12 adjacent to the front surface defines a pair of second recesses 123. A pair of poles 124 forms on the bottom face of the elongate body 12 for soldering to the corresponding holes of the PCB.

The conductive contacts 2 and the insulative housing 1 may be insert molded together. Or, each conductive contact 2 may include a mounting section (not visible), a connecting section 23 extending from one end of the mounting section, a contact section 22 extending forwardly from the other end of the mounting section, and a solder section 21. The contact sections 22 are received in the elongate grooves 130. The bottom ends of the contact portions 22 project from the surface of the elongate grooves 130 for contacting with the conductive contacts of a mating connector (not shown). The solder portions 21 are placed on the same plane with the insulative housing 1 for soldering to the PCB.

The shell 3 includes a bottom plate 30, a top plate 31, a pair of side plates 32 projecting from the top plate 31 and a pair of connecting plates 33. The pair of side plates 32 extends downwardly from the top plate 31. The connecting plates 33 are located at the back of the shell 3 for connecting the bottom plate 30 and the top plate 31. A guiding slot 300 is defined at the front end of the bottom plate 30, and a pair of engaging plates 301 extends from the rear edge of the bottom plate 30. A first notch 302 and a second notch 303 are defined at two side edges of the bottom plate 30. Each bottom edge of the side plates 32 extends outwardly to form a solder plate 320 for soldering to the PCB. A tang 321 projects inward from each side plate 32. A pair of stopping plates 312 projects from the rear edge of the top plate 31 adjacent the side plates 32. Particularly, the stopping plates 312 are on the same plane with the top plate 31 when the insulative housing 1 is not assembled with the shell 3.

Figure 2:
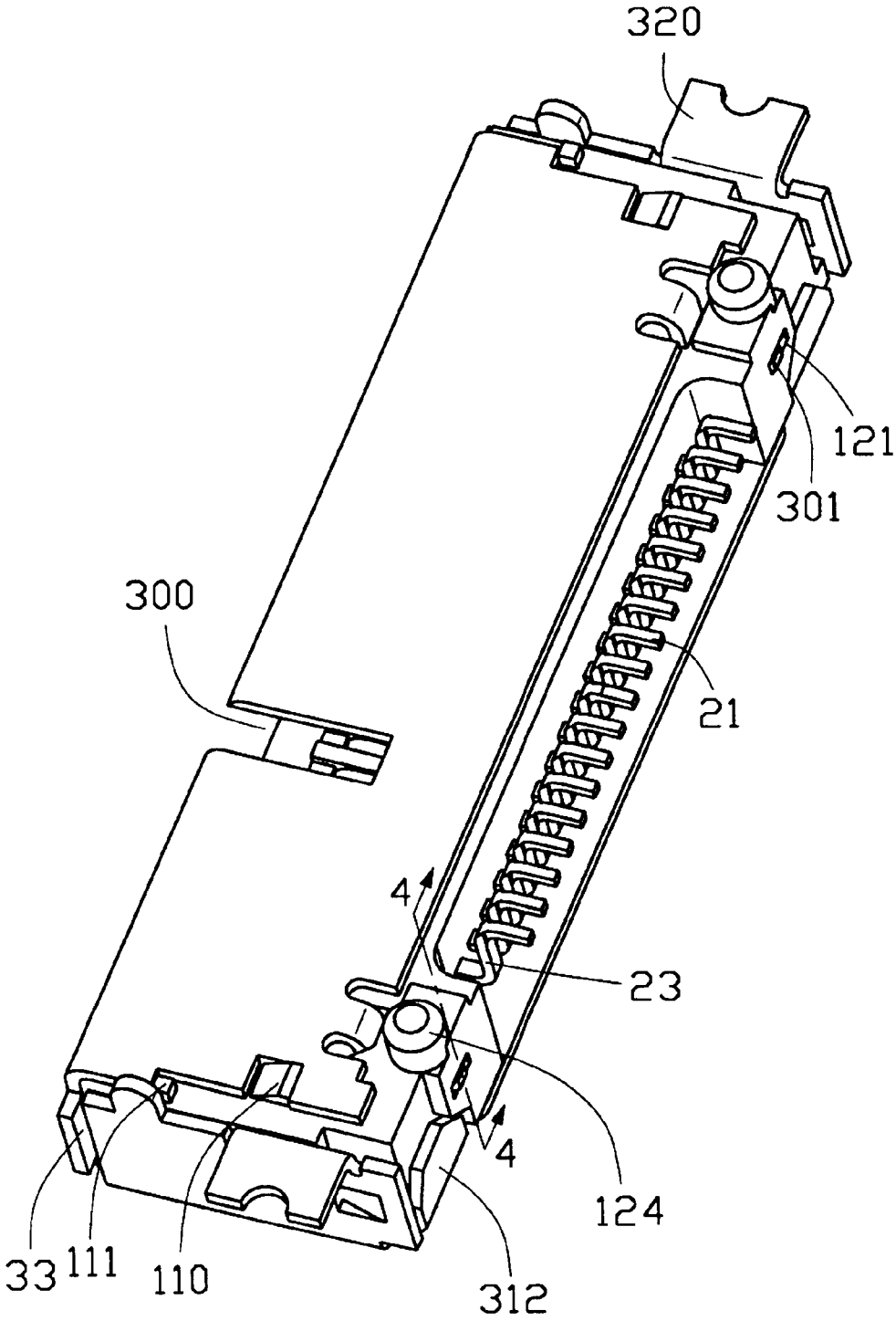
FIG. 2 is an assembled view of the I/O connector of FIG. 1.
Figure 3:
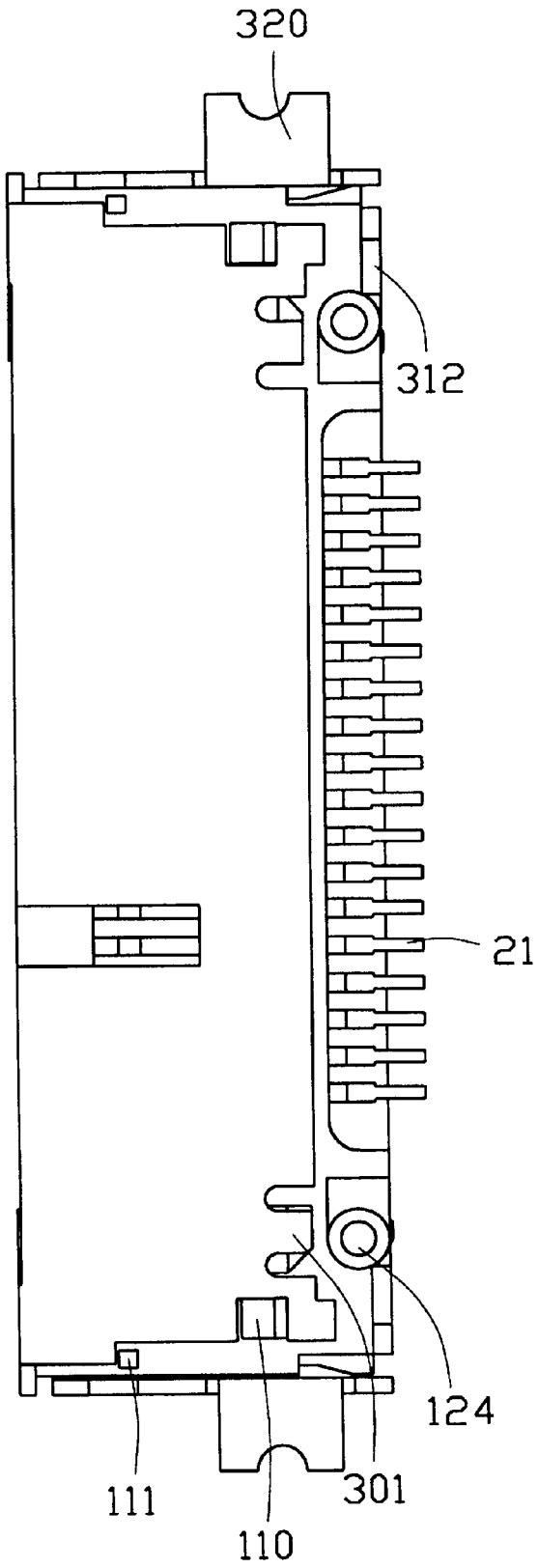
FIG. 3 is a top plan view of the I/O connector of FIG. 2.
Figure 4:
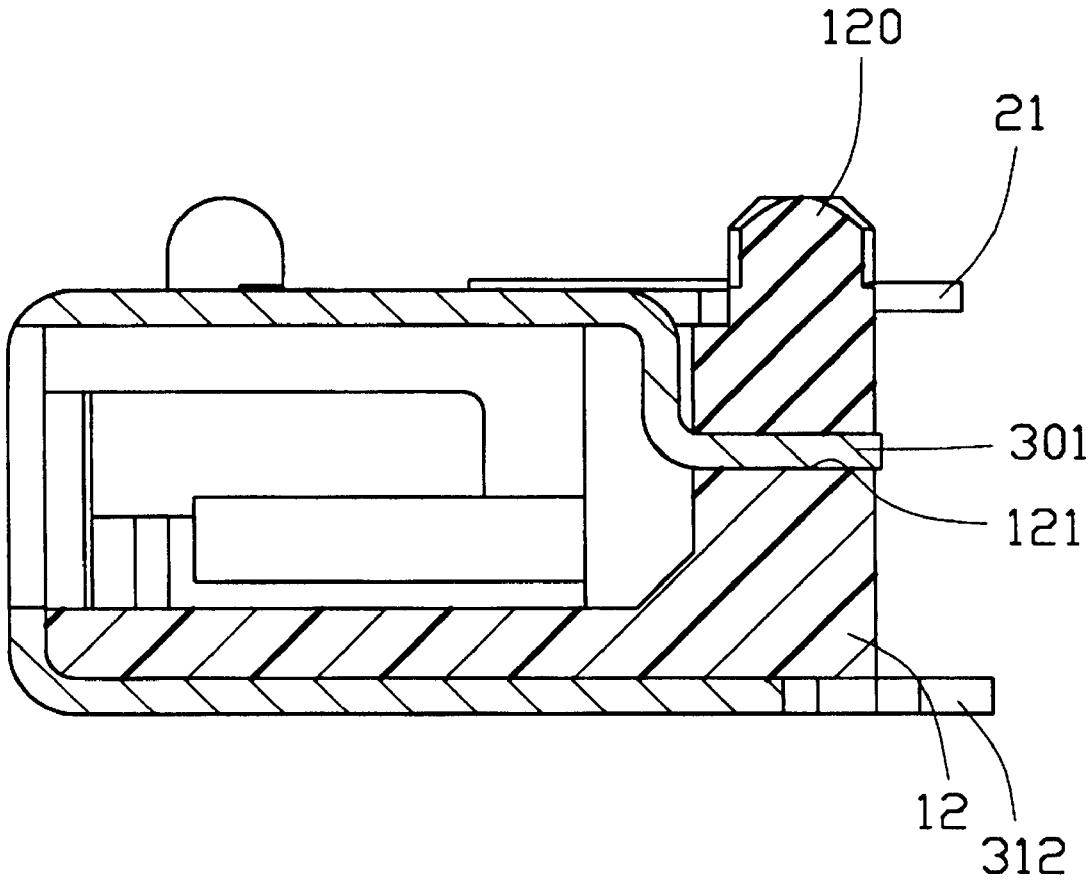
FIG. 4 is a cross-sectional view taken along line 4—4 of FIG. 2.

Referring to FIGS. 2–4, after assembly, the insulative housing 1 is inserted into the shell 3 from the rear end thereof. The engaging plates 301 are received in the slots 121 of the insulative housing 1 for preventing the insulative housing 1 and the shell 3 from producing relative displacement. The first and second blocks 110, 112 are held at the first and second notches 302, 303. The pair of stopping plates 312 are bent to be received in the first recesses 122 for preventing the insulative housing from horizontally moving. The tangs 321 are held at the second recesses 123.

Therefore, the insulative housing 1 and the shell 3 are assembled reliably together.

In the present invention, through the engaging plates 301 of the shell 3 being inserted into the slots 121 of the insulative housing 1, during soldering the I/O connector to the PCB and subsequent cooling process, the shell will not displace relative to the insulative housing, and the solder sections 21 of the conductive contacts 2 can reliably connect with the traces on the PCB 5. Therefore, the present invention overcomes the deficiencies of the conventional I/o connectors.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An input/output connector for mounting on a printed circuit board, comprising: an insulative housing having a pair of horizontally oriented slots; extending along a front-to-back direction in a bottom portion of said housing a plurality of conductive contacts retained in the insulative housing for surface mounting to the printed circuit board; and a metal shell including a bottom plate, a top plate, a pair of side plates projecting from the top plate and a pair of connecting plates joining the bottom plate and the top plate, the bottom plate having a pair of angled engaging plates horizontally. received in the slots of the insulative housing, said shell enclosing the housing and being assembled thereto in said front-to-back direction;

wherein each engaging plate extends upwardly and rearwardly from a rear edge of the bottom plate of the shell;

wherein the insulative housing comprises an elongate body and a pair of parallel side arms at two sides of the elongate body, each side arm has a first block and a second block at a bottom face thereof, and the bottom plate of the shell has a first notch and a second notch for engaging with said first and second blocks, respectively;

wherein the insulative housing comprises a pair of first recesses formed beside said slots, and the top plate of the shell defines a pair of stopping plates received in the first recesses;

wherein said side plate of the shell comprises a tang, and the insulative housing comprises a second recess for engaging with said tang;

wherein said bottom plate is not directly connected to the side plates but is connected to the top plates via said connecting plates located at a front portion of the housing;

wherein the engaging plates are vertically offset from said bottom plate;

wherein said slots are located above and vertically aligned with respective posts which extend downwardly from a bottom face of the body.

* * * * *